United States Patent [19]

Westerlund

[11] 4,046,665

[45] Sept. 6, 1977

[54] ELECTRODE ASSEMBLY FOR DIAPHRAGM CELLS

[75] Inventor: Gothe Oscar Westerlund, Vancouver, Canada

[73] Assignee: Chemetics International Ltd., Montreal, Canada

[21] Appl. No.: 750,887

[22] Filed: Dec. 15, 1976

[30] Foreign Application Priority Data

Jan. 7, 1976 Canada ..... 243239

[51] Int. Cl.[2] ..... C25B 13/02; C25C 7/04; C25B 9/00

[52] U.S. Cl. ..... 204/282; 204/252

[58] Field of Search ..... 204/282, 283, 252

[56] References Cited

U.S. PATENT DOCUMENTS

| | | | |
|---|---|---|---|
| 3,878,082 | 4/1975 | Gokhale | 204/282 X |
| 3,910,827 | 10/1975 | Raetzsch et al. | 204/283 X |
| 3,944,477 | 3/1976 | Argade | 204/283 X |

*Primary Examiner*—John H. Mack
*Assistant Examiner*—D. R. Valentine
*Attorney, Agent, or Firm*—Guy Drouin

[57] ABSTRACT

An electrode assembly comprising in combination:

A. an elongated titanium bar of rectangular transversal cross-section having a pair of major planar opposed surfaces and a pair of minor planar opposed surfaces;

B. a finned electrode consisting essentially of a plurality of elongated spacer bars of uniform width and thickness mounted in stacked parallel relationship on one of said major planar surfaces and a plurality of elements maintained in spaced parallel relationship throughout their length by said spacers, each element having a bottom flat wall of a width not less than that of the spacers and a pair of spaced outwardly sloping sidewalls each including an outwardly extending ledge; said spacers and elements being made of a metal selected from iron, copper, cobalt, nickel and alloys of these metals; and C. enveloping the finned electrode, a prefabricated diaphragm having uniformly spaced corrugations of a wave length equal to the distance between two adjacent ledges, said diaphragm being so positioned on the electrode that each ledge has its longitudinal edge in contact therewith at the bottom of a corrugation.

In the electrode assembly, the cathode and diaphragm membrane are preassembled and form a unit which can readily be combined with anodes in the formation of multi unit cells.

4 Claims, 5 Drawing Figures

ELECTRODE ASSEMBLY FOR DIAPHRAGM CELLS

This invention relates to electrolytic diaphragm cells for the production of chlorine, caustic soda and hydrogen by the electrolysis of alkali metal chloride solutions, and is more particularly concerned with an electrode assembly for use in such cells.

The art of producing chlorine, caustic soda and hydrogen by electrolysis of brine in a diaphragm cell has been practised for many decades. Over the years the technology has continuously been perfected and new materials of construction have become available whereby efficiency, production capacity and economies of the cell have appreciably improved. In recent years the most significant advance in diaphragm cells for making chlorine, caustic soda and hydrogen has undoubtedly been the replacement of the graphite anodes by the so called dimensionally stable anodes which are made of a valve metal such as titanium in the form of a sheet, mesh or profiles surface coated with a noble metal or noble metal oxides. A more recent advance is the introduction of prefabricated diaphragms of fabric type as a replacement for the traditional in-situ fabricated asbestos diaphragms. To date, some difficulties have been encountered in attempts to install the prefabricated diaphragms in conventional cells of the type wherein diaphragmed cathodes are disposed in alternate, parallel and spaced relationship with anode plates in the cell vessel.

It is a general object of this invention to provide an electrode assembly which makes it possible to take advantage of said recent developments in both anodes and diaphragms.

A more specific object of the invention is to provide an electrode assembly in which a cathode and a diaphragm membrane are preassembled and form a unit which can readily be combined with anodes in the formation of multi unit cells.

Other objects and advantages of this invention will become apparent in the following description.

Broadly speaking, the electrode assembly of the invention comprises in combination:

A. an elongated titanium bar of rectangular transversal cross-section having a pair of major planar opposed surfaces and a pair of minor planar opposed surfaces;

B. a finned electrode consisting essentially of a plurality of elongated spacer bars of uniform width and thickness mounted in stacked parallel relationship on one of said major planar surfaces and a plurality of elements maintained in spaced parallel relationship throughout their length by said spacers, each element having a bottom flat wall of a width not less than that of the spacers and a pair of spaced outwardly sloping sidewalls each including an outwardly extending ledge; said spacers and elements being made of a metal selected from iron, copper, cobalt, nickel and alloys of these metals, and C. enveloping the finned electrode, a prefabricated diaphragm having uniformly spaced corrugations of a wave length equal to the distance between two adjacent ledges, said diaphragm being so positioned on the electrode that each ledge has its longitudinal edge in contact therewith at the bottom of a corrugation.

The invention will now be described with reference to the accompanying drawings which are to be considered as illustrative only and in which like reference numerals represent only and in which like reference numerals represent like parts. In these drawings.

Figure 1:
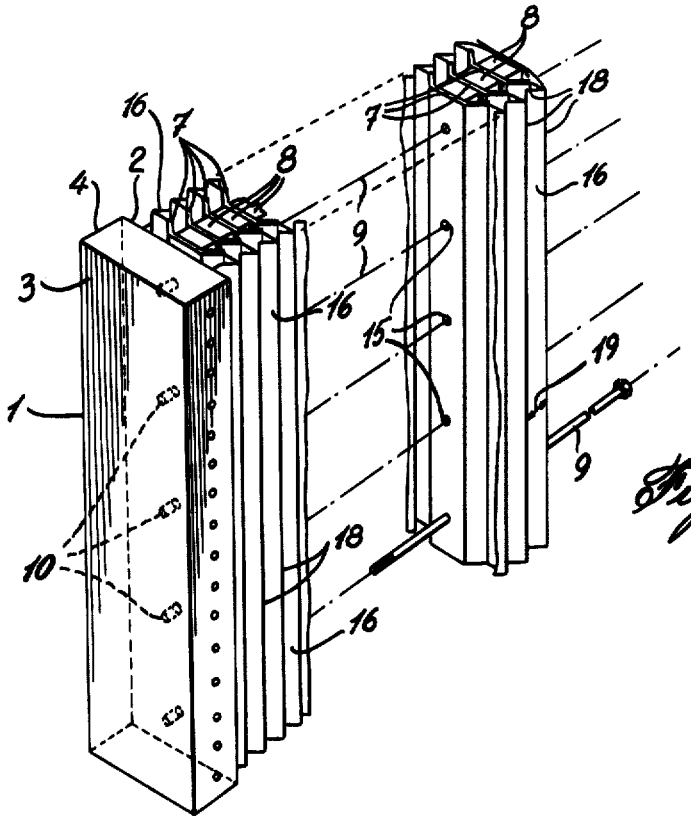
FIG. 1 is a broken perspective view of an electrode according to the invention.

Referring to FIG. 1 for a more detailed description of the preferred embodiment of the present invention, there is shown a diaphragmed electrode assembly suitable for use in electrolytic production of chlorine and caustic soda from sodium chloride solutions. In general the electrode assembly includes an elongated titanium bar 1 of rectangular transversal cross-section presenting a pair of major planar opposed surfaces 2 and 3 and a pair of minor planar opposed surfaces 4 and 5. Across the width of the bar and opening on both minor surfaces 4 and 5 are a number of parallel bore holes 6 the function of which will appear hereinafter. Mounted lengthwise on major surface 2 of titanium bar 1 are a number of trough-like cathodic elements 7 maintained in spaced parallel relationship by a number of spacer bars 8. Said cathodic elements 7 and spacer bars 8 together form a cathode projecting perpendicularly from surface 2 of bar 1 and are maintained in stacked relation by means of long bolts schematically shown at 9. Suitable threaded holes 10 are provided in surface 2 of bar 1 to receive bolts 9. It should be understood however that elements 7 and spacer bars 8 can be fixed to bar 1 by any suitable means other than bolting.

Figure 2:
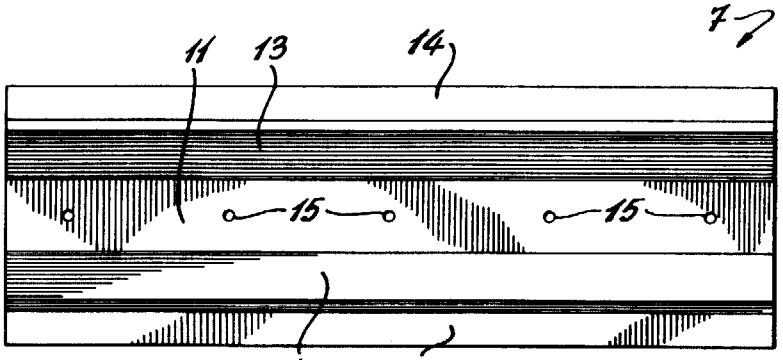
FIG. 2 is an elevational view of one of the finconstituting elements embodied in the electrode of FIG. 1.
Figure 3:
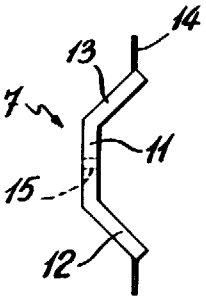
FIG. 3 is a cross-sectional view of the element of FIG. 2.

For details of construction of cathodic elements 7, reference is made to FIGS. 2 and 3 which illustrate one element in full size scale in width but not in length. Essentially element 7 is a trough-like profile having a bottom falt wall 11 and a pair of spaced outwardly sloping sidewalls 12 and 13 each including an outwardly extending ledge 14 of reduced thickness. In alignment with the threaded holes 10 of bar 1, bore holes 15 are provided through bottom flat wall 11 to receive bolts 9. As it appears clearly in FIG. 1 the bottom wall 11 of each element 7 of the electrode receives a spacer bar 8 and should be at least as wide as said spacer 8 so as not to be distorted when an assemblage it is tightened against titanium bar 1 by means of bolts 9. Cathodic elements 7 and spacer bars 8 can be made of any cathodic material selected from iron, copper, cobalt, nickel and alloys of these metals but preferably they are made of mild steel.

Figure 5:
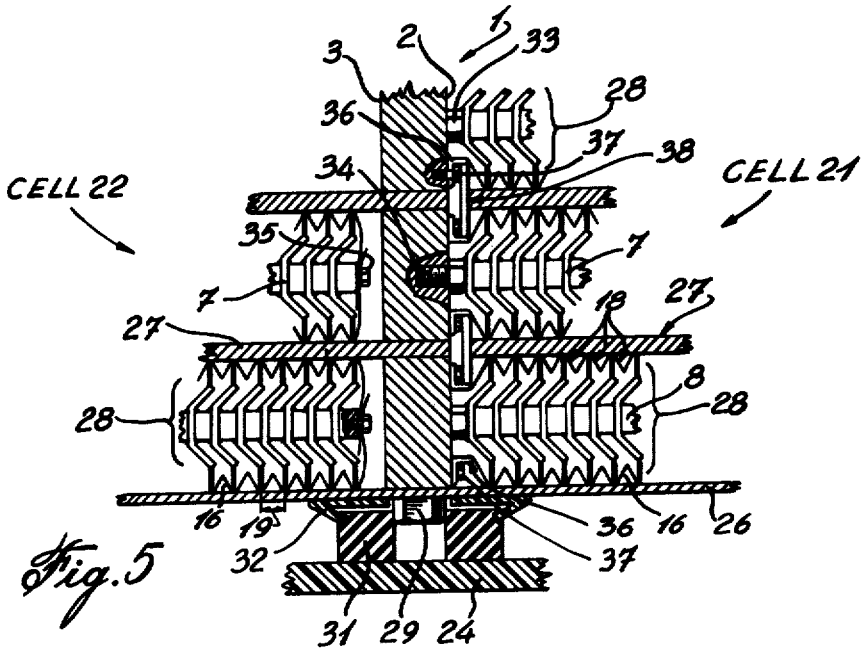
FIG. 5 is an enlarged view of circled section A of FIG. 4.
Figure 4:
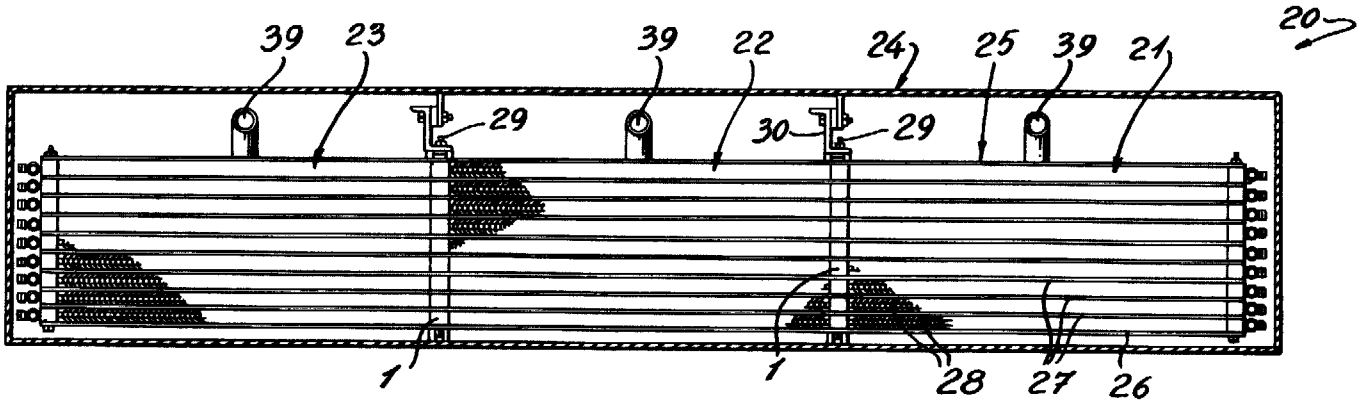
FIG. 4 is a top plan view of a multi unit cell comprising electrodes according to the invention.

Returning to FIG. 1 and also having regard to FIGS. 4 and 5, it is seen that elements 7 and spacer bars 8 once assembled together by means of bolts 9 tightened into threaded holes 10 of bar 1 form an electrode plate 28 (see FIGS. 4 and 5) or more precisely a cathode plate having on both of its faces a series of regularly spaced fins formed by sidewalls 12 and 13 and ledges 14 of elements 7. Resting directly on the edges of the ledges 14 and entirely masking both faces of the cathode plate 28 is prefabricated diaphragm membrane 16. Suitable for use as diaphragm are woven fabrics made from polytetrafluoroethylene, polyvinylidene fluoride and the perfluorosulphonic acid membrane offered to the industry under the tradmark "Nation,"

The diaphragm membrane 16 is provided with uniformly distributed corrugations 18 extending longitudinally of elements 7 of the cathode and having a wave length 19 equal to the distance separating two adjacent ledges 14. Said diaphragm 16 is further so disposed on the finned cathode that the ledges 14 contact its surface at the bottom of corrugations 18 and that the corrugations 18 falling between ledges 14 penetrate the spaces between adjacent ledges. The diaphragm may be attached to the cathode by any suitable means one of which is illustrated in FIG. 5.

In FIG. 4, there is shown a multi unit cell 20 including three cells 21, 22 and 23 horizontally disposed in end-to-end relationship within a fibre reinforced plastic enclosure 24. Each cell comprises a vessel consisting of a bottom wall (not shown) and a pair of opposed vertical plastic side walls 25 and 26 between which a series of anodes 27 and a series of cathodes 28 as provided by the present invention are disposed in alternating parallel relationship to each other and separated from each other by the diaphragm membrane 16.

Referring to FIG. 5 for details of constructions, it is shown that cathodes 28 projecting into cell 21 are maintained in parallel relationship by disposing the titanium bars 1 upon which they are mounted (as explained hereabove) in vertical side-by-side relationship whereas the anodes 27 projecting into next cell 22 are maintained in parallel relationship by virtue of a marginal side portion thereof equal in width to the thickness of titanium bar 1 being inserted one between the two units of each pair of said titanium bars. The whole is maintained in fixed position by means of a series of bolts 29 passing through transverse holes 6 in bar 1 (see FIG. 1) and corresponding holes practised in plastic side walls 25 and 26 as well as in said marginal side portions of anodes 27. The thus assembled titanium bars 1 and marginal side portions of anodes 27 form the dividing wall between adjacent cells 21 and 22. Bolts 29 also serve, as shown in FIG. 4, to secure one side of enclosure 24 by means of a profile 30 made of any suitable electrically insulating plastic. The other side of enclosure 24 is secured by means of a combination of foam rubber bars 31 and plastic clips 32, the latter being cemented to vertical wall 26 of the cells.

Also shown in FIG. 5 is different way of mounting cathode 28 on titanium bar 1. In this particular embodiment, the cathodic elements 7 and spacer bars 8 are welded to each other in alternate stacked relationship, the cathodic element closest to titanium bar 1 being in turn welded on top of the heads of a series of machine bolts 33 screwed into screw threaded holes 34 drilled part-way through said titanium bar 1. Said bolts are made of the same metal as that of elements 7 and spacer bars 8.

The diaphragm membrane 16 illustrated in FIG. 5 is made of two pieces, one for each face of cathode 28. At the free outward end of the cathode, the two pieces are overlapped and attached to said cathode end by means of a series of screws 35. At the titanium bar end of the cathode each piece of the diaphragm has its end clamped between the surface 2 of the titanium bar and an angle profile 36 by means of screws 37, said profile and screws being made of any suitable electrically insulating plastic such as glass fibre reinforced polyester, ebonite rubber, etc. Resting on the heads of screws 37 and between the projecting wings of each pair of adjacent angle profiles 36 is a band 38 of an electrically insulating sheet material upon the surface of which the vertical free end of anodes 27 comes into abutment.

It is thus seen from the above description that the electrode assembly of the present invention permits the creation of bipolar cells in which cathodes 28 and anodes 27 are interdigitated and are separated from each other by a very short distance which can be equivalent to the thickness of the diaphragm membrane 16. Such a small distance between anode and cathode (the anode/-cathode gap) permits, in operation of the cell, to keep the ohmic losses and hence the cell voltage to a minimum. At the same time it makes it possible to operate at an economic current density, for example 2 $KA/m^2$.

In operation, collectors (not shown) of any suitable construction are provided at the top and bottom of cathodes 28 for collecting hydrogen at said top and caustic soda at said bottom. The bottom collectros, for instance, are all interconnected and lead to a caustic soda discharge pipe 39 (shown in FIG. 4). Chlorine is in turn liberated in the space between corrugated diaphragm 16 and anodes 27.

What we claim is:

1. An electrode assembly comprising in combination:

A. an elongated titanium bar of rectangular transversal cross-section having a pair of major planar opposed surfaces and a pair of minor planar opposed surfaces;

B. a finned electrode consisting essentially of a plurality of elongated spacer bars of uniform width and thickness mounted in stacked parallel relationship on one of said major planar surfaces and a plurality of elements maintained in spaced parallel relationship throughout their length by said spacers, each element having a bottom flat wall of a width not less than that of the spacers and a pair of spaced outwardly sloping sidewalls each including an outwardly extending ledge; said spacers and elements being made of a metal selected from iron, copper, cobalt, nickel and alloys of these metals; and C. enveloping the finned electrode, a prefabricated diaphragm having uniformly spaced corrugations of a wave length equal to the distance between two adjacent ledges, said diaphragm being so positioned on the electrode that each ledge has its longitudinal edge in contact therewith at the bottom of a corrugation.

2. An electrode assembly as claimed in claim 1 wherein said spacer bars and said elements are made of mild steel.

3. An electrode assembly as claimed in claim 1 wherein the diaphrgm is a woven fabric made of polytetrafluoroethylene or polyvinylidene fluoride.

4. An electrode assembly as claimed in claim 1 wherein the diaphragm is a perfluorosulphonic acid membrane.

* * * * *